US009295296B2

(12) United States Patent
Clement et al.

(10) Patent No.: US 9,295,296 B2
(45) Date of Patent: Mar. 29, 2016

(54) PROTECTIVE HEADGEAR FOR COMBAT SPORTS

(71) Applicant: HAYABUSA FIGHTWEAR INC., Kingston (CA)

(72) Inventors: Ken Clement, Milton (CA); Craig Clement, Kingston (CA); John David Zikakis, Mount Albert (CA)

(73) Assignee: HAYABUSA FIGHTWEAR, INC., Kingston, Ontario (CA)

( * ) Notice: Subject to any disclaimer, the term of this patent is extended or adjusted under 35 U.S.C. 154(b) by 403 days.

(21) Appl. No.: 13/801,515

(22) Filed: Mar. 13, 2013

(65) Prior Publication Data

US 2013/0326798 A1 Dec. 12, 2013

Related U.S. Application Data

(60) Provisional application No. 61/657,251, filed on Jun. 8, 2012.

(51) Int. Cl.

| | |
|---|---|
| ***A42B 3/12*** | (2006.01) |
| ***A42B 1/22*** | (2006.01) |
| ***A63B 71/10*** | (2006.01) |
| ***A42B 3/06*** | (2006.01) |
| ***A42B 3/00*** | (2006.01) |

(52) U.S. Cl.

CPC ... *A42B 3/12* (2013.01); *A42B 3/00* (2013.01); *A42B 3/069* (2013.01); *A63B 71/10* (2013.01); *A63B 2244/10* (2013.01)

(58) Field of Classification Search

CPC ..... A63B 2244/10; A63B 2244/102; A63B 2244/108; A63B 71/10; A63B 2244/104; A63B 2244/106; A42B 1/22; A42B 3/145; A42B 3/127; A42B 1/08; A42B 3/069; A42B 3/00; A42B 3/12; A42B 3/125; A42B 3/20; A42B 3/205; A42B 7/00

USPC ..... 2/425, 417, 418, 419, 420, 411, 9

See application file for complete search history.

(56) References Cited

U.S. PATENT DOCUMENTS

| | | | | | |
|---|---|---|---|---|---|
| 1,023,285 | A | * | 4/1912 | White | 2/9 |
| 1,112,358 | A | * | 9/1914 | Cline | 2/9 |
| 1,449,183 | A | * | 3/1923 | Johnstone | 2/9 |
| 1,488,812 | A | * | 4/1924 | Goodman | 2/9 |
| 2,020,248 | A | * | 11/1935 | Shibe | 2/9 |
| 2,364,571 | A | * | 12/1944 | Turner | 2/9 |
| 2,458,025 | A | | 1/1949 | Portal | |
| 2,768,380 | A | * | 10/1956 | Golomb | 2/420 |
| 3,156,923 | A | * | 11/1964 | Timm | 2/419 |
| 3,327,316 | A | | 6/1967 | Pukish | |
| 3,628,191 | A | | 12/1971 | Douglas | |
| 3,820,780 | A | * | 6/1974 | Tarbox | 482/10 |
| 3,934,271 | A | | 1/1976 | Rhee | |
| 4,222,122 | A | * | 9/1980 | Toms | 2/9 |
| 4,317,239 | A | * | 3/1982 | Bryksa | 2/411 |
| 4,706,305 | A | | 11/1987 | Cho | |
| 4,847,921 | A | | 7/1989 | Leutholt et al. | |
| 6,247,181 | B1 | * | 6/2001 | Hirsch et al. | 2/207 |
| 6,349,416 | B1 | * | 2/2002 | Lampe et al. | 2/411 |

* cited by examiner

*Primary Examiner* — Amy Vanatta

(74) *Attorney, Agent, or Firm* — Moore & Van Allen PLLC

(57) ABSTRACT

A protective headgear is disclosed. The headgear protects regions of the wearer's head including the crown, temples, and chin. The headgear has a closure system having two adjustable closures, operating substantially perpendicular to each other and to reinforce one another, that act to provide custom fit for the headgear and to maintain a field of view for the wearer during use and after repeated uses.

9 Claims, 13 Drawing Sheets

PROTECTIVE HEADGEAR FOR COMBAT SPORTS

FIELD OF THE INVENTION

The present invention relates generally to a protective headgear, and more specifically to a headgear used in various combat sports such as boxing, kickboxing, karate, wrestling, grappling and mixed martial arts, and also to a headgear used for protecting the head of the wearer from hits by an opponent.

BACKGROUND

U.S. Pat. No. 4,706,305, by Soo S. Cho, describes a foam headgear for protecting against blows to the head during martial arts. The headgear is of foam structure covering the back of the head, the forehead, and the ears/sides of the head. It is designed to conform to the shape of the head; however the only adjustable mean is a chin strap joining the two ear portions. While this headgear does not impair vision of the wearer it does lack customized fit and adequate protection, particularly at the front of the chin.

U.S. Pat. No. 4,847,921, by Robert M. Leutholt et al., describes a protective headgear for use in combat sports involving impacts to the head. The headgear is primarily concerned with eye protection and thus provides relatively little protection for other parts of the head. Furthermore, while stating that it does not "unduly limit vision" because the eyes are individually surrounded by padding forming elliptical holes for each eye, it is clear that vision is significantly impacted. The headgear is secured by conventional cooperating straps that connect at the back of the head. There is also a crown strap that loops around the other straps and fastens to itself. These straps interact in such a way to encourage separation of the cooperating straps and do not act to maintain the field of view.

Wrestling headgear is primarily concerned with protecting the ears of the wearer and not typically designed to withstand impacts or strikes as these are not normally part of the sport. U.S. Pat. No. 3,327,316, by M. S. Pukish, Jr., and U.S. Pat. No. 3,628,191, by Boddy E. Douglas, show headgear representative of this type that consist of ear protection pads joined by several straps and do not impede vision. However, although this headgear may be well-suited for custom fitting, it offers inadequate protection for combat sports that involve striking. Furthermore, a wrestling headgear often contains one or more hard shells as components of the ear cups, which are not suitable for most combat sports involving striking.

U.S. Pat. No. 3,934,271, by Jhoon Rhee, describes a headgear having openings conforming to the eyes, nose, mouth, chin and ears in one embodiment, or one large opening conforming to the face (including the eyes, nose, mouth, and chin) in another embodiment. In all embodiments, the headgear by Rhee is not customizable for fit and lacks adequate chin protection for combat sports involving strikes.

U.S. Pat. No. 2,458,025, by De Witt A., describes a headgear for a boxer that utilizes a semi-rigid plate at the front of the headgear through which slots are cut out to allow unrestricted vision and breathing. Specifically, a T-shaped opening structure is described. In most contemporary uses, the rigid plate is not appropriate for competition and not well-suited for training.

There is need for headgear that is customizable in fit, which offers suitable protection for the head of the wearer while maintaining a field of view so as not to obstruct the vision of the wearer.

SUMMARY OF THE INVENTION

The present invention provides headgear that seeks to overcome many of the limitations of the prior art headgear for use in combat sports. The present invention provides a protective headgear that offers a closure system that presents adjustable custom fit and necessary protection while acting to maintain the field of view of the wearer.

In one embodiment of the present invention, there is provided a protective headgear having a body comprising a crown portion and opposing side portions. The headgear also comprises a closure system having first and second adjustable closures that operate generally perpendicular to each other. Forward facing inner edges of the crown and opposing side portions define a face opening and rear facing inner edges of the crown and opposing side portion define a gap.

In another embodiment, the first adjustable closure comprises a first strap that extends horizontally across the gap from a rear facing portion of one of the opposing side portions. The opposite side portion has a slot for receiving the first strap, the first strap having a reversible attachment system for reversibly securing upon itself.

In a further embodiment, a second adjustable closure comprises a second strap that extends vertically across the gap from a portion of the first strap. The second strap passes through a slot in a rear facing portion of the crown portion of the body and has a reversible attachment system for securing to itself, the first strap, or a combination thereof.

In another embodiment, the body comprises a chin portion. In some embodiments, the chin portion is contiguous with the opposing side portions. In other embodiments, the chin portion comprises a chin closure system that also incorporates padding.

In a further embodiment, the face opening is hourglass-shaped having inward protrusions of the opposing side regions to cover parts of the cheeks of the wearer.

In a first aspect, the present invention provides a protective headgear for wearing by an individual comprising: a body having a crown portion for covering at least a portion of a crown of the individual and opposing first and second side portions for covering at least a portion of the individual's temples; a first adjustable closure, operatively coupled to the body; and a second adjustable closure, operatively coupled to the body; wherein the first and second closures are movable to operatively secure the headgear on the individual and are movable in a substantially perpendicular direction relative to one another.

In a second aspect, the present invention provides a method of securely and adjustably applying a protective headgear upon the head of an individual, comprising steps of: (a) adjusting a first adjustable closure; (b) adjustably securing the first adjustable closure; (c) adjusting a second adjustable closure; and (d) adjustably securing the second adjustable closure; wherein the first and the second adjustable closures are movable in a direction substantially perpendicular to one another, such that the first adjustable closure is operatively coupled to the headgear to reinforce and securely maintain the second adjustable closure and the second adjustable closure is operatively coupled to the headgear to reinforce and securely maintain the first adjustable closure.

In a third aspect, the present invention provides a method for maintaining the field of view of an individual wearing a protective headgear comprising the steps of: (a) adjusting a first adjustable closure; (b) adjustably securing the first adjustable closure; (c) adjusting a second adjustable closure; and (d) adjustably securing the second adjustable closure; wherein the first and the second adjustable closures are movable in a direction substantially perpendicular to one another, and the adjustable securing of one of the first and the second adjustable closures acts to bias a face opening in the headgear to adopt and maintain a field of view and at least one breathing orifice for the individual.

BRIEF DESCRIPTION OF THE DRAWINGS

Embodiments of the present invention will now be described, by way of example only, with reference to the attached Figures, wherein.

DETAILED DESCRIPTION

Figure 1:
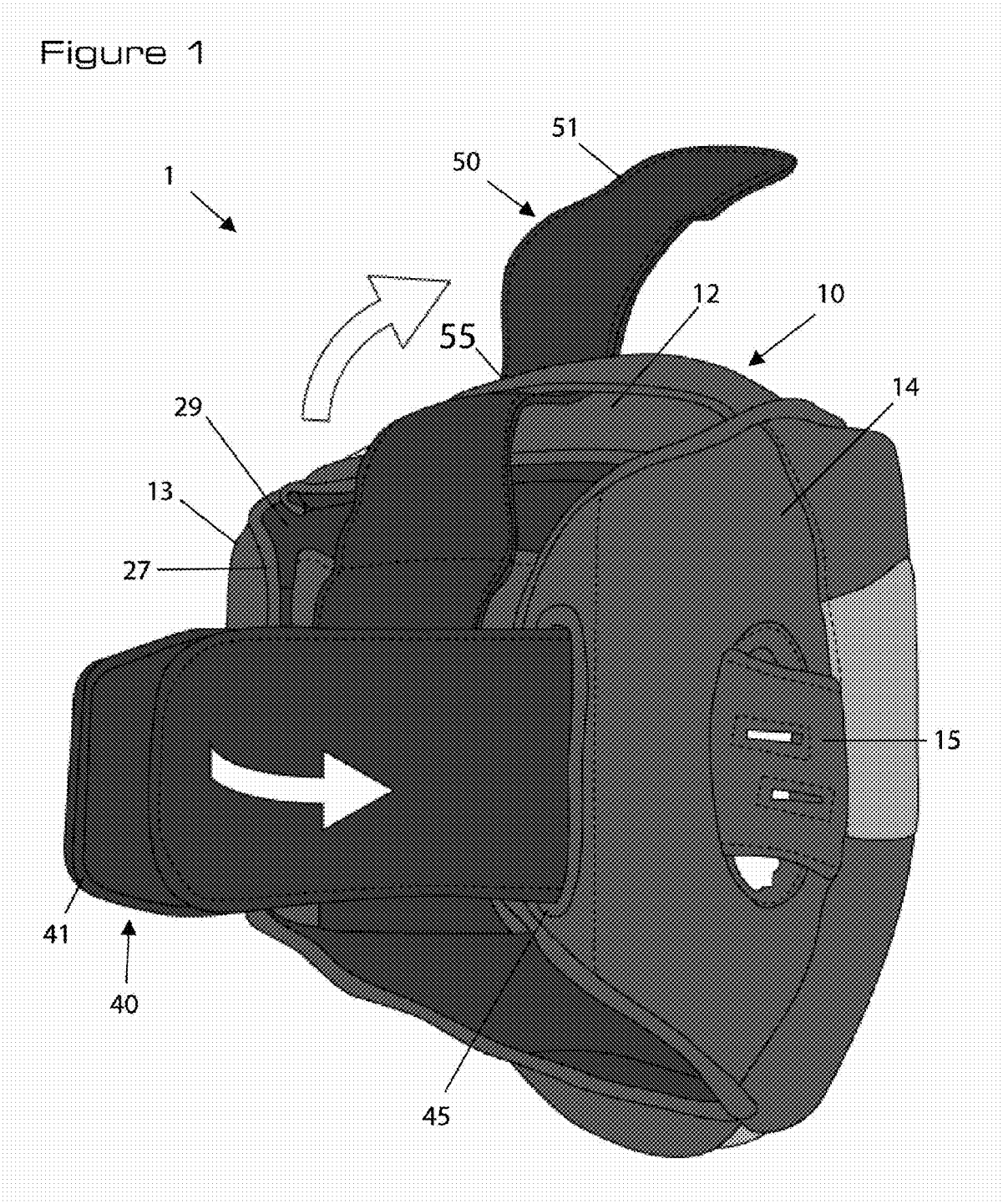
FIG. 1 shows a rear perspective view of the headgear having the closure open in accordance with an embodiment of the present invention.

Throughout, reference is made to direction such as front, back, horizontal, vertical, etc. It is herein understood that such references are, unless otherwise stated, relative to the orientation of the headgear when worn on the head of an individual, wherein the individual is standing upright. Thus, the front is herein understood to be forward-facing or the face's side; the back or the rear is herein understood to be rear-facing, or opposite the face; the horizontal reference is herein understood to be across, mostly parallel to the ground plane; and the vertical reference is herein understood to be mostly perpendicular to the ground plane, or up-and-down.

The terms "coupled" and "connected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

The present invention seeks to provide a protective headgear that is customizable in fit during use, even after repeated use that also maintains a field of view for the wearer that is improved over most comparable headgear, while offering desired protection to the wearer. The headgear of the present invention is also advantageously lighter relative to similar prior art headgear.

The headgear 1, shown throughout FIGS. 1-8, has a body 10 that comprises portions that cover select areas of the wearer's head as desired. A crown portion 12 covers at least a portion of the top of the head and, in some aspects, may extend downward toward the brow and may cover a portion of the wearer's forehead. The crown portion encircles the top portion of the wearer's head and may cover areas of the front, sides, and back of the head.

The body also comprises opposing first and second side portions 13 and 14, respectively that extend downward from the crown portion to cover at least a portion of the sides of the wearer's head and may include the temples and cheeks. In some aspects, one or both of the opposing side portions may have a region that extends to cover at least a portion of the back of the wearer's head. In other aspects, the opposing side portions may have ear-holes 15 corresponding to the ears of the wearer to partially expose at least a portion of the ears as shown in the Figures. These ear-holes 15 will serve to facilitate proper hearing and will also allow for improved comfort through fit and ventilation.

According to another embodiment of the present invention, the ears holes 15 may be partially covered with a section of material (as shown), or ear flap (not shown), to facilitate hearing but also increase protection. This section of material may be perforate or solid, but is preferably arranged so as not to cover the entire ear-hole 15.

Figure 2:
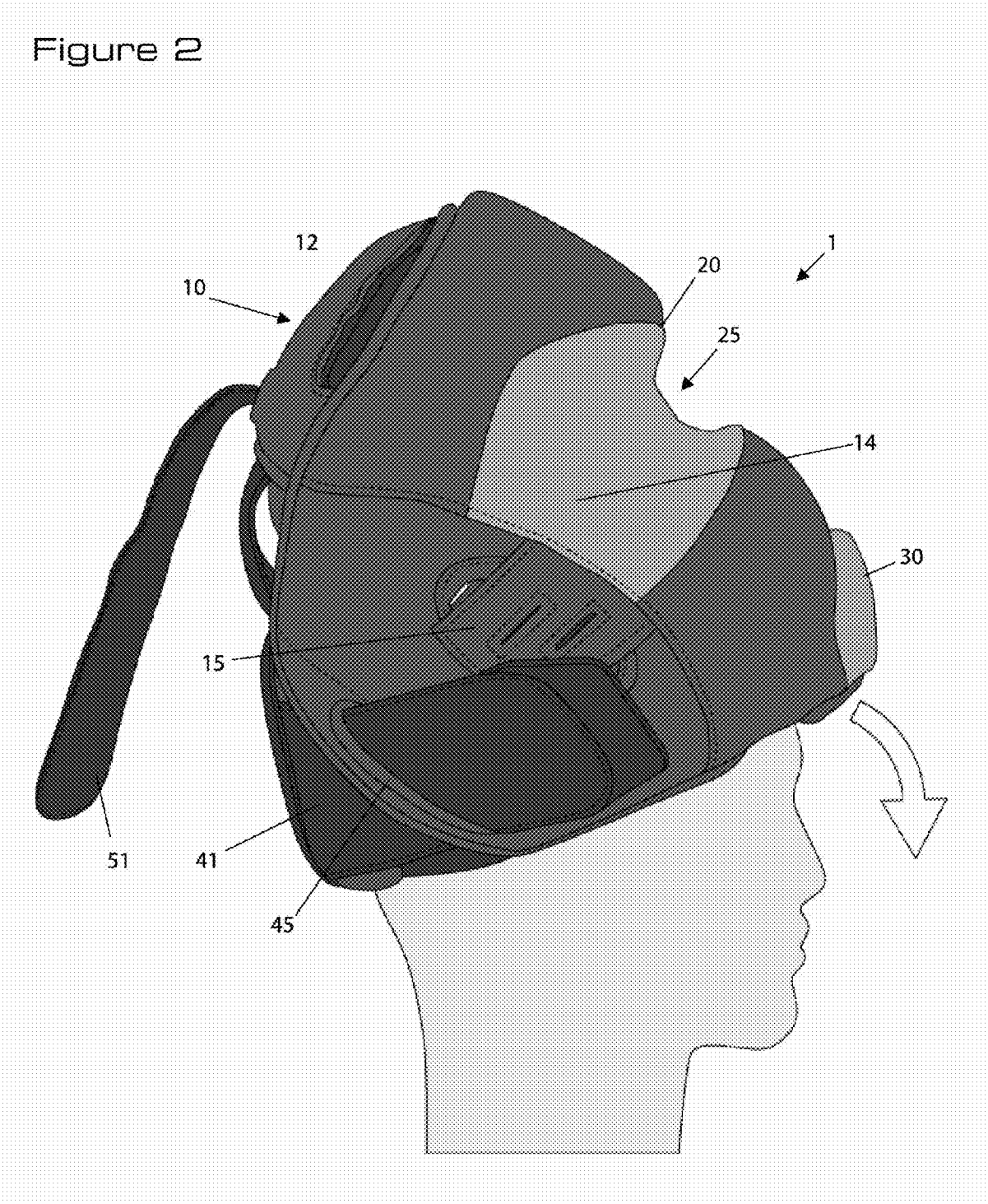
FIG. 2 shows a side view of the headgear shown in FIG. 1 as it is being applied to the head of the wearer.
Figure 3:
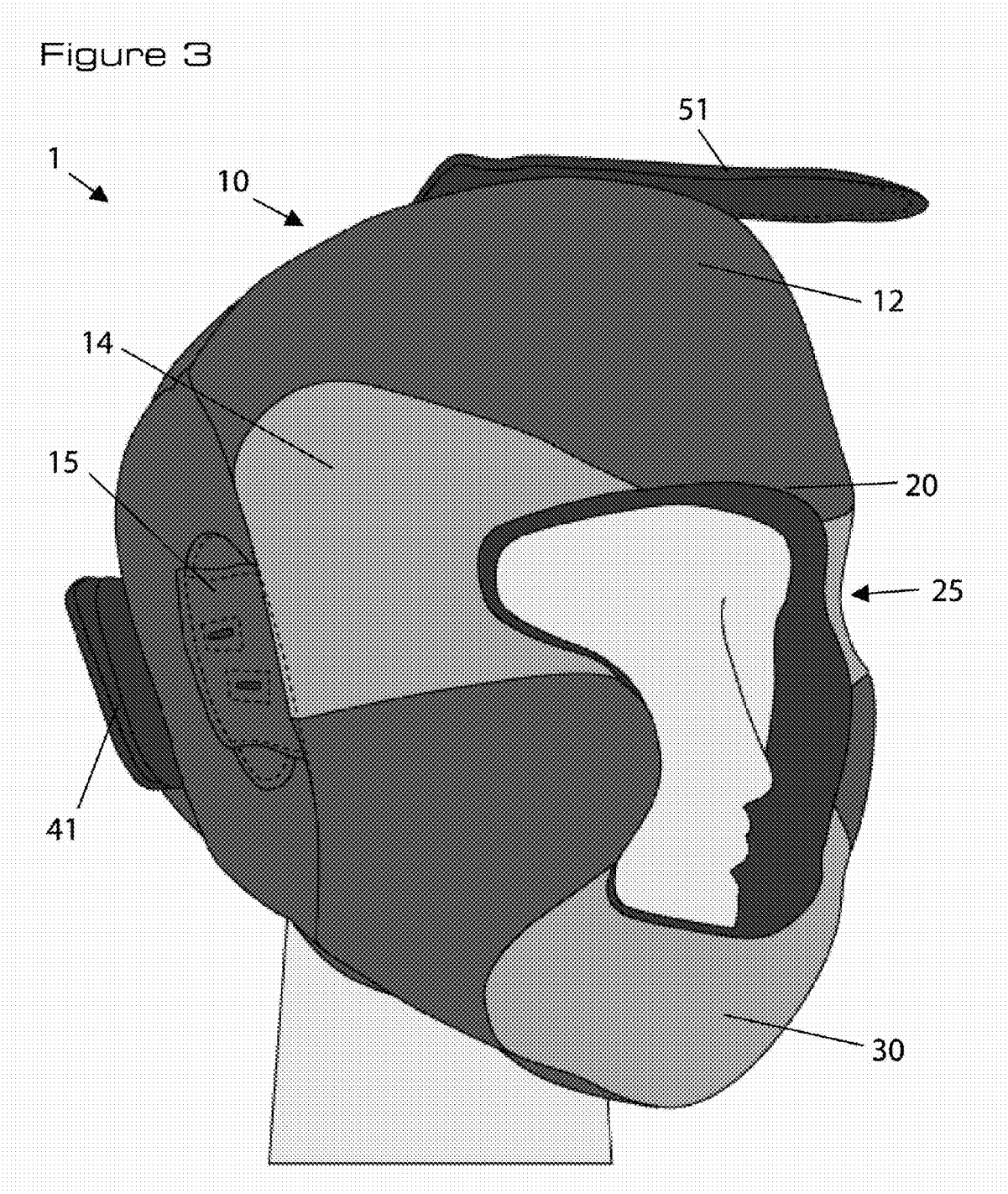
FIG. 3 shows a front perspective view of the headgear shown in FIGS. 1 and 2 having been set on the head of the wearer.

The crown portion 12 and the first and second side portions 13 and 14 have forward facing inner edges 20, as shown in FIG. 2, that define a face opening 25 at least partially exposing the eyes, nose, and mouth of the wearer as shown in FIG. 3. In some aspects, the opposing side portions have a region that extends inward at a middle region to provide increased coverage and protection of the cheeks of the wearer. In these aspects, a face opening 25 is hour-glass shaped. The rear facing inner edges 27 of the crown 12 and the opposing side portions 13 and 14 define a gap 29 at the rear of the body 10 of headgear 1 as shown in FIGS. 1 and 4 through 7. In some aspects, at least one of the rear facing inner edges 27 of opposing side portions 13 and 14 may as a protrusion provide extra protection across the gap 29.

In one embodiment, the headgear body also further comprises a chin portion 30 for covering at least a portion of the chin of the wearer, as shown in FIGS. 2 and 3. In some aspects, the chin portion 30 is contiguous with, and part of, the first and second side portions 13 and 14, which extend downward and inward to cover at least a portion of the chin.

In another embodiment, the chin portion 30 comprises a chin closure. The chin closure may be a strap of material that is adjustably securable by any suitable means. A particularly preferred means is with a hook-and-loop type of fastener. A further preferred means is a single strap extending across the chin of the wearer, originating from the forward facing inner edge 20 of one of the opposing side portions, through a slot in the opposite side portion, and securing against itself after being directed back towards the originating side portion. The strap of the chin closure may be of any suitable type of fabric or combination of fabrics. Also, the chin closure may comprise padding such that, when secured, the chin closure provides protection for the chin of the wearer in addition to providing extra customization of fit of the headgear.

The various portions of the body of the headgear may be separate sections fastened together during production, or preferably, the body may be formed of a unitary piece. The body may be made of any suitable material to provide the necessary protection; it may be made of a single material, such as an impact absorbing foam, or may be made of a combination of several materials for different portion or layers of different suitable materials.

The headgear 1 also comprises a closure system that has a first adjustable closure 40 and a second adjustable closure 50. The first adjustable closure 50 operates horizontally across the back of the headgear, spanning the gap 29 between the rear facing edges of the opposing side portions 13 and 14. In a preferred embodiment, the first adjustable closure is a strap 41 of the material, originating from a rear facing edge 27 of either the first or second side portions 13 and 14 of the body, passes across gap 29 and through a slot 45 in the opposite side portion and is pulled back across the gap toward the originating side portion to be reversibly fixed upon itself, preferably by hook-and-loop sections.

The second adjustable closure 50 operates vertically across the back of the headgear 1. In a preferred embodiment, the second adjustable closure 50 is a strap 51 of material originating from the first opposing strap 41 and is passed upward through a slot 55 in the crown portion 12 near a rear facing edge 27, and is pulled back downwards toward the origin of strap 51 to be reversibly fixed upon itself, i.e., upon the first adjustable closure 40 or strap 41 (already having been secured), or a combination of both. The straps 41 and 51 of both closures 40 and 50 may be of any suitable material that may be elastic, inelastic, or a combination of both. To facilitate the reversible fixing of the closure, a hook-and-loop type fastener is preferred and would be placed on portions and sides of the straps to facilitate adjustable fixation of the straps to the headgear.

Figure 6:
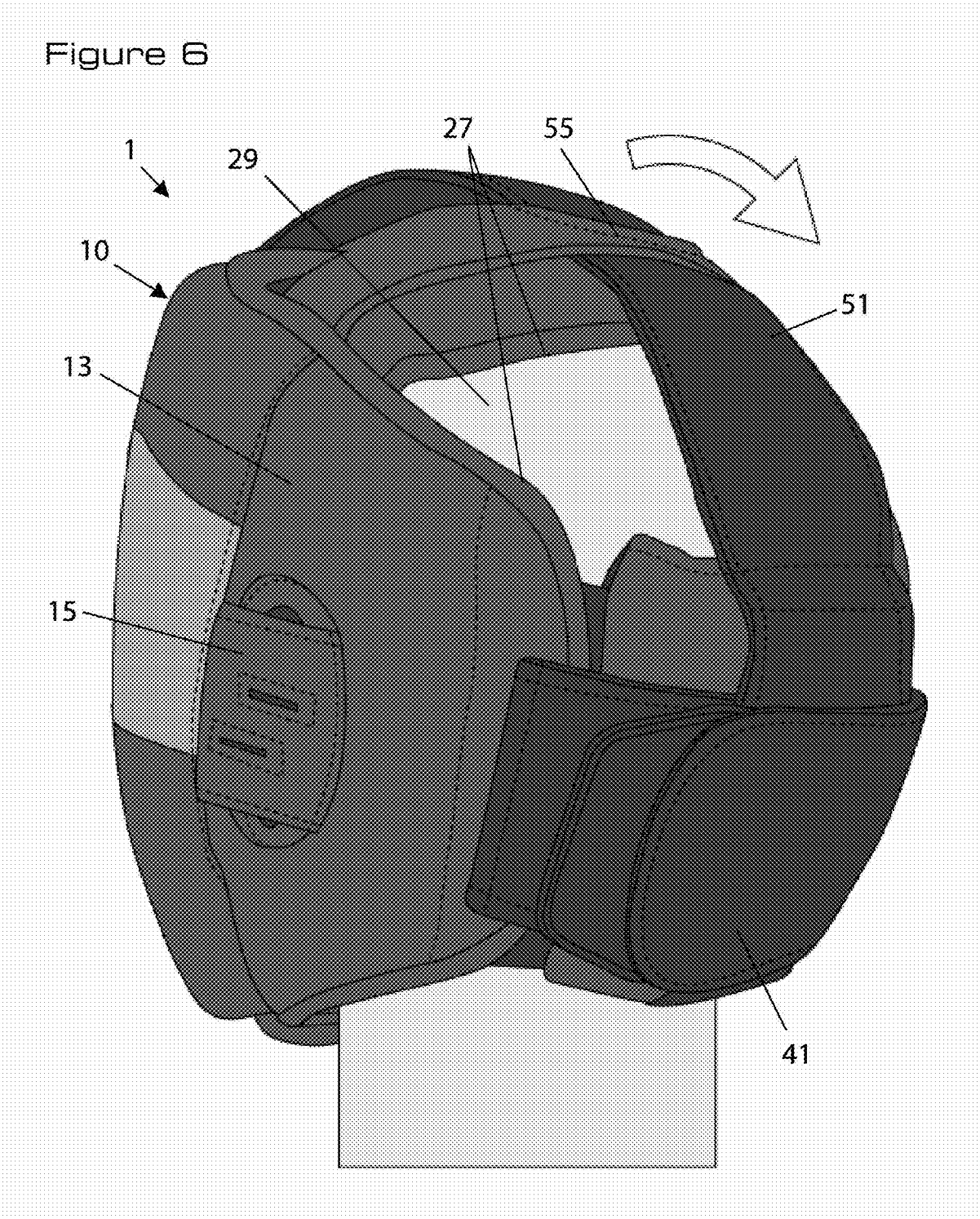
FIG. 6 shows a rear perspective view of the head shown in FIGS. 1-5 with the first adjustable closure secured and the second adjustable closure being tightened by pulling upward to set the proper fit.
Figure 7:
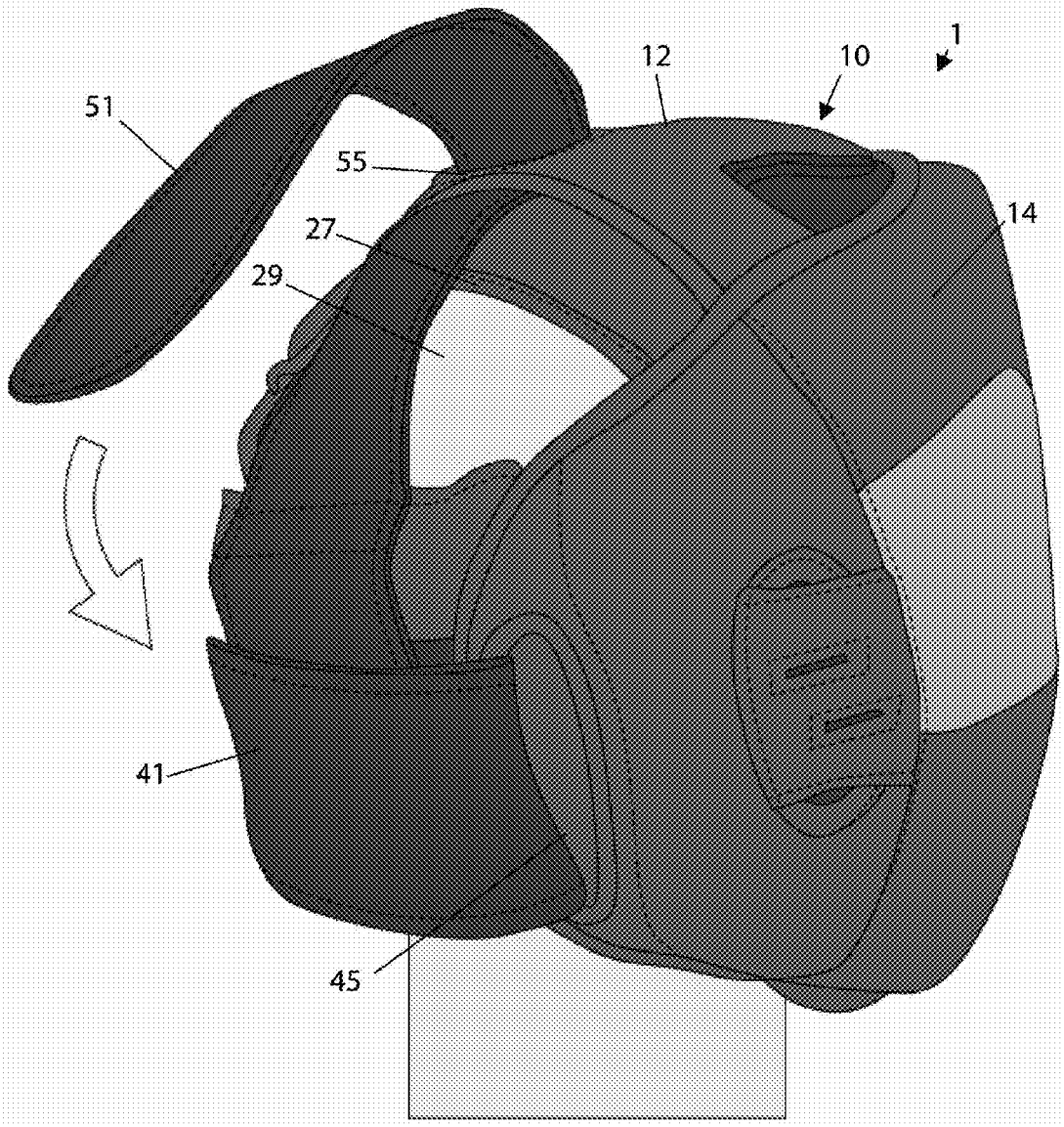
FIG. 7 shows a rear perspective view of the headgear shown in FIGS. 1-6 with the second adjustable closure being secured after being tightened by pulling downward.
Figure 8:
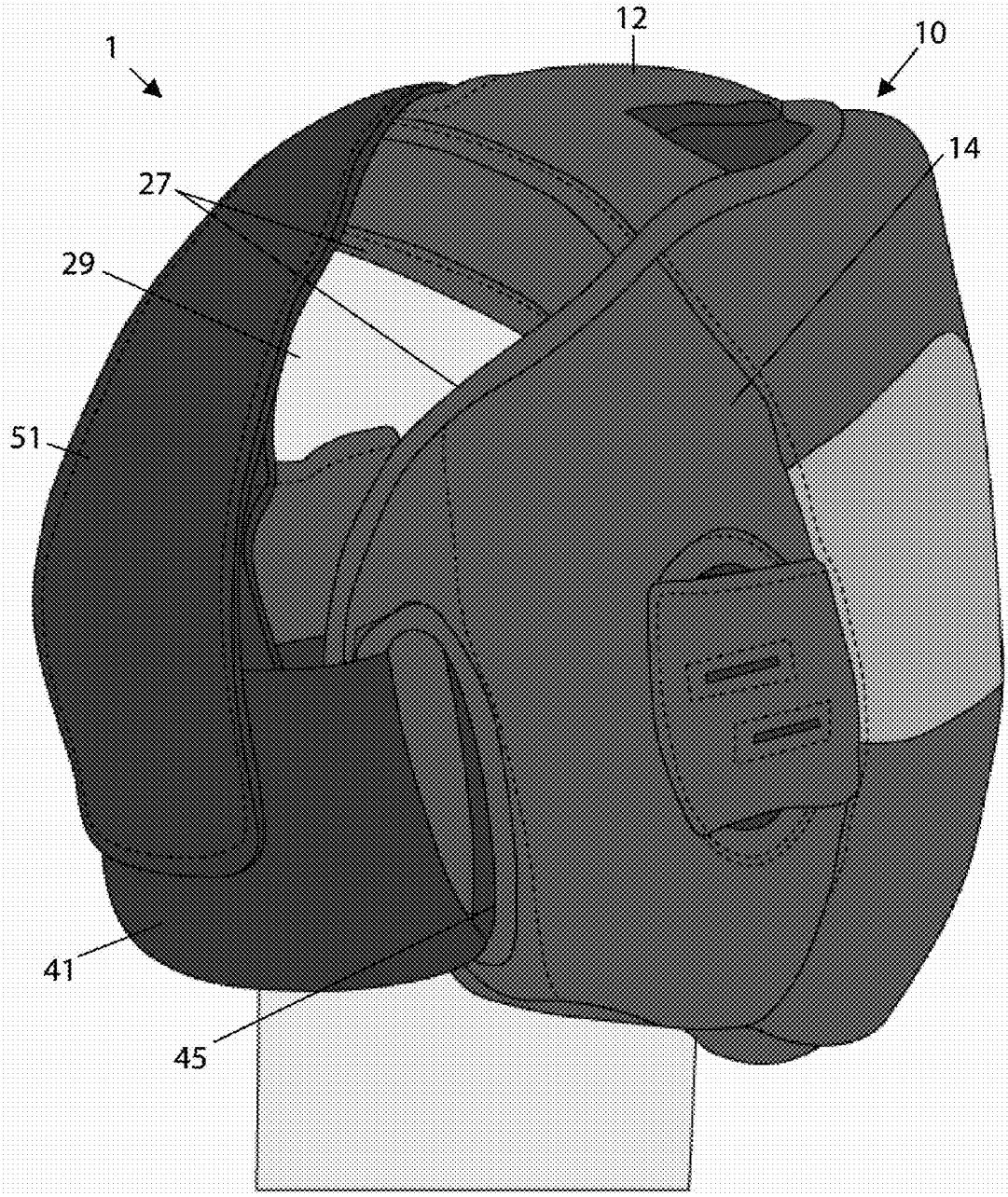
FIG. 8 shows a rear perspective view of the headgear shown in FIGS. 1-7 having both adjustable closures secured.

The sequence of applying and securing the inventive headgear according to a preferred embodiment is shown through FIGS. 1 to 8. In FIG. 8, both adjustable closures 40 and 50 are disengaged by pulling in the direction of the large open arrows. This way, the body 10 of the headgear 1 may be fully opened, or expanded to allow the wearer to easily apply the headgear 1. As shown in FIG. 2, the headgear 1 is slid down overtop the head of the wearer in a direction shown by the large open arrow. FIG. 3 shows the headgear 1 being properly placed over the wearer's head, so that the face opening 25 is properly positioned for the wearer's field of view and breathing orifices. The closures 40 (not visible in FIG. 3) and 50 are still disengaged.

Figure 4:
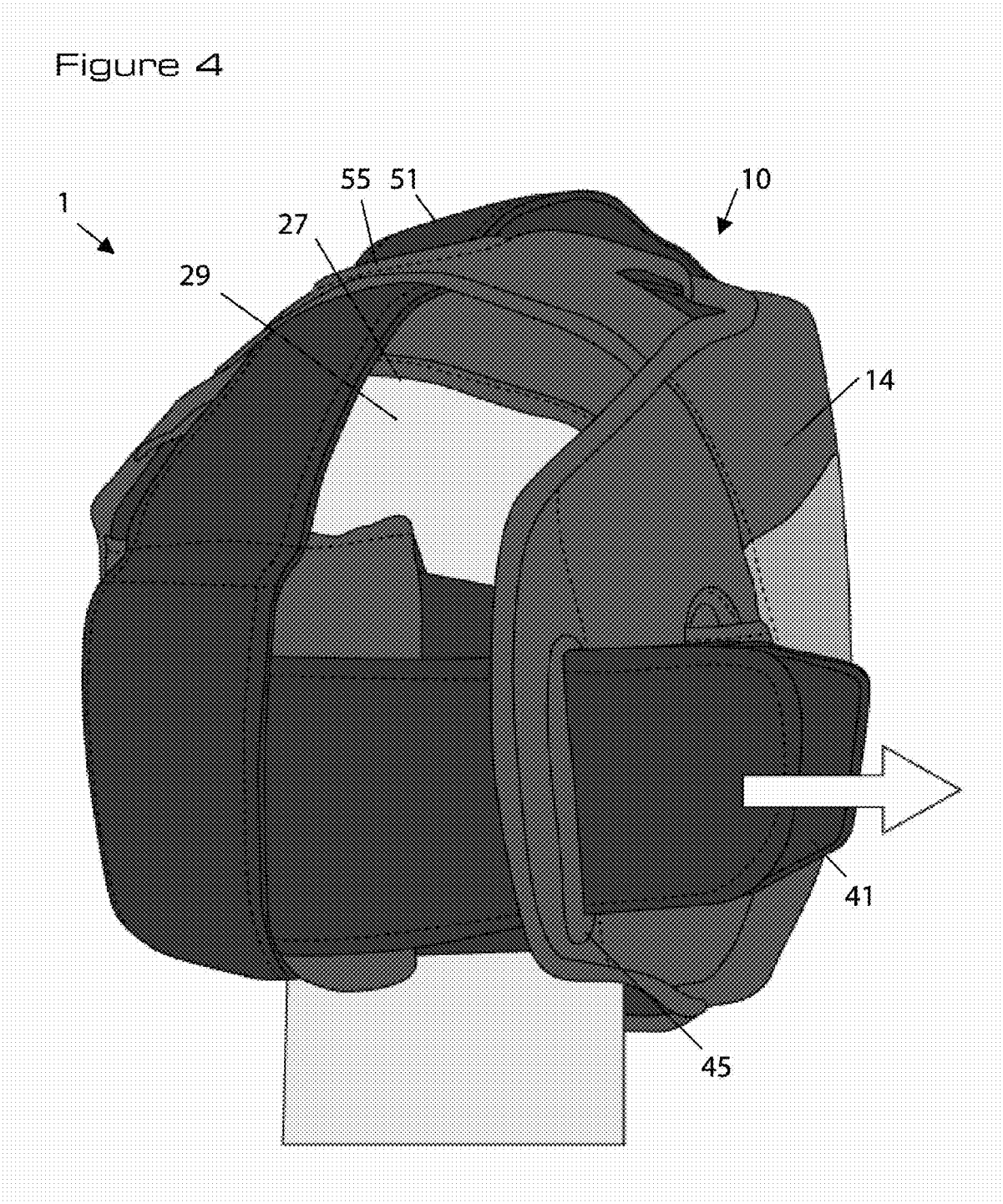
FIG. 4 shows a rear perspective view of the headgear shown in FIGS. 1-3 as the first adjustable closure is being tightened by pulling across and away from the headgear to set the proper fit.
Figure 5:
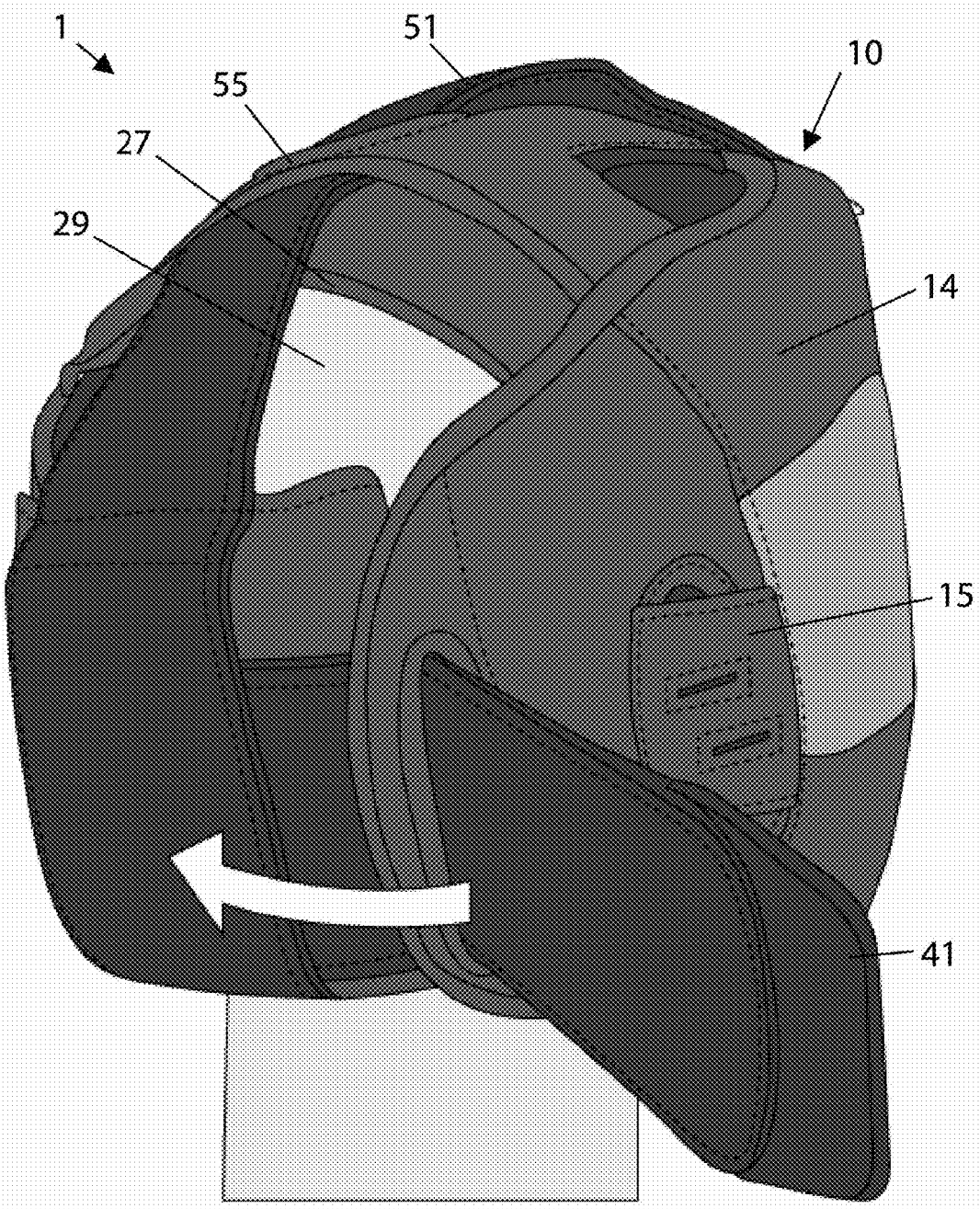
FIG. 5 shows the perspective view shown in FIG. 4 with the first adjustable closure being secured after being tightened.

FIG. 4 shows strap 41 of the first closure 40 being tightened by pulling in the direction of the large open arrow. FIG. 5 shows a strap 41 being secured upon itself after pulling it in the opposite direction used to tighten the strap 41 against the headgear 1, as shown by the large open arrow. The second adjustable closure 50 is tightened by pulling in the direction of the large open arrow as shown in FIG. 6. As shown in FIG. 7, the second adjustable closure 50 is secured by pulling the strap 51 in the direction of the large open arrow and securing it against itself and upon the first adjustable closure 40. FIG. 8 shows the headgear 1 fully secured and custom fitted.

The two perpendicular straps of the closure system are utilized to reinforce one another, to provide adjustable custom fit, and to maintain the field of vision by biasing the peripheral edges of the face opening outward. The closure system of the present invention contrasts the hook-and-loop strap systems of the prior art, which either comprise a single strap that spans across a distance to adhere to a matching section on the opposite side, or alternatively comprise two strap portions that meet in a middle region to adhere to one another. In either of these prior art cases, any forces during activity act to separate the complementary hook-and-loop portions. The closure system of the present invention employs two straps that are generally perpendicular to each other and interact in such a way that the hook-and-loop of one strap secures over the other after the other has been secured. This provides a more secure closure that is less susceptible to stretching and unfastening during use. Even through repeated use, as the first and second adjustable closures may become stretched, which would normally compromise the field of view of the wearer and loosen the fit, the inventive headgear maintains the integrity of the fit and field of view conjointly.

In order to test and compare the inventive headgear with comparable prior art headgear, the inventors conducted a series of tests.

Figure 9:
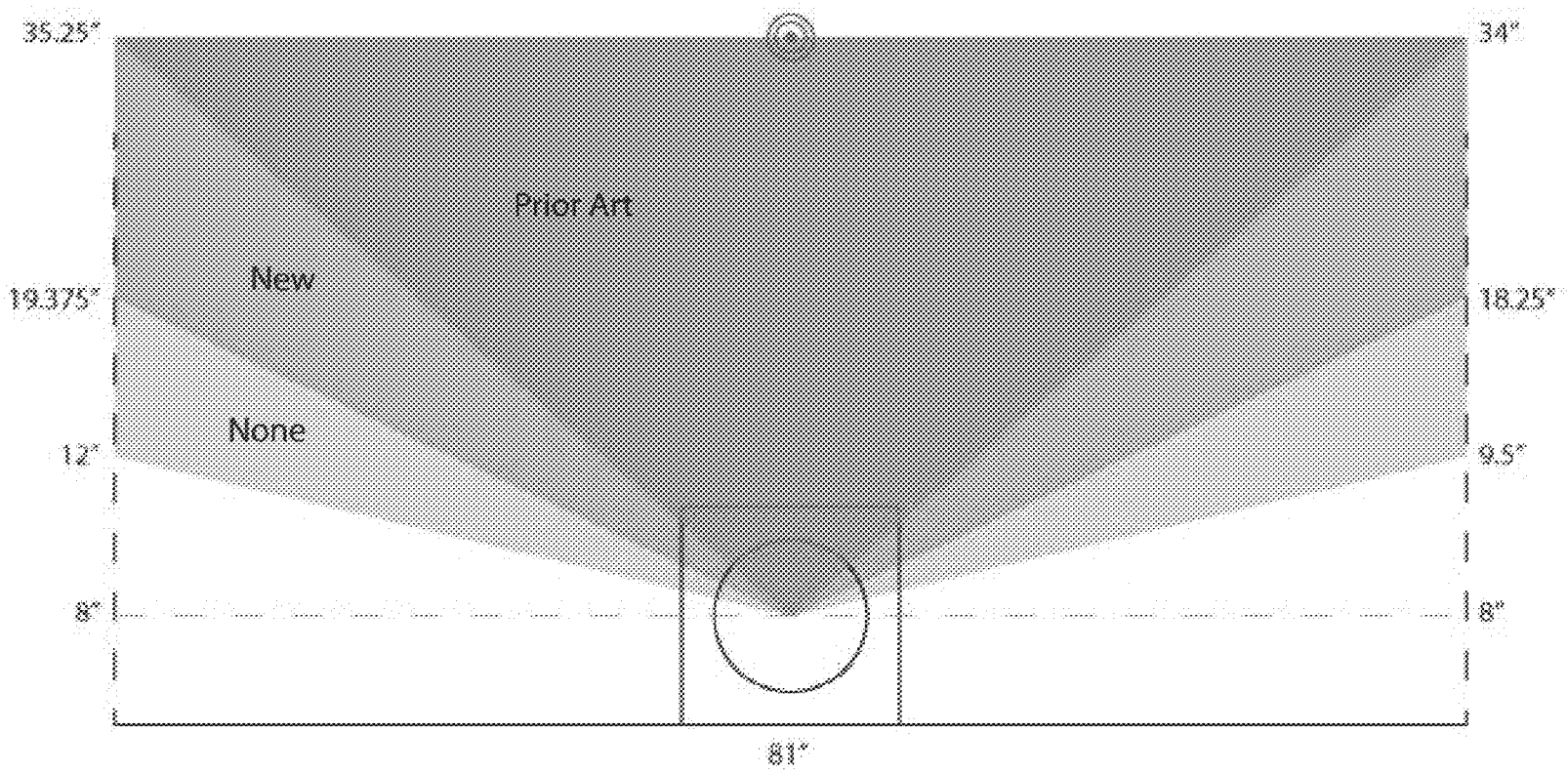
FIG. 9 shows a representation of a test for a horizontal field of view for a first user.
Figure 10:
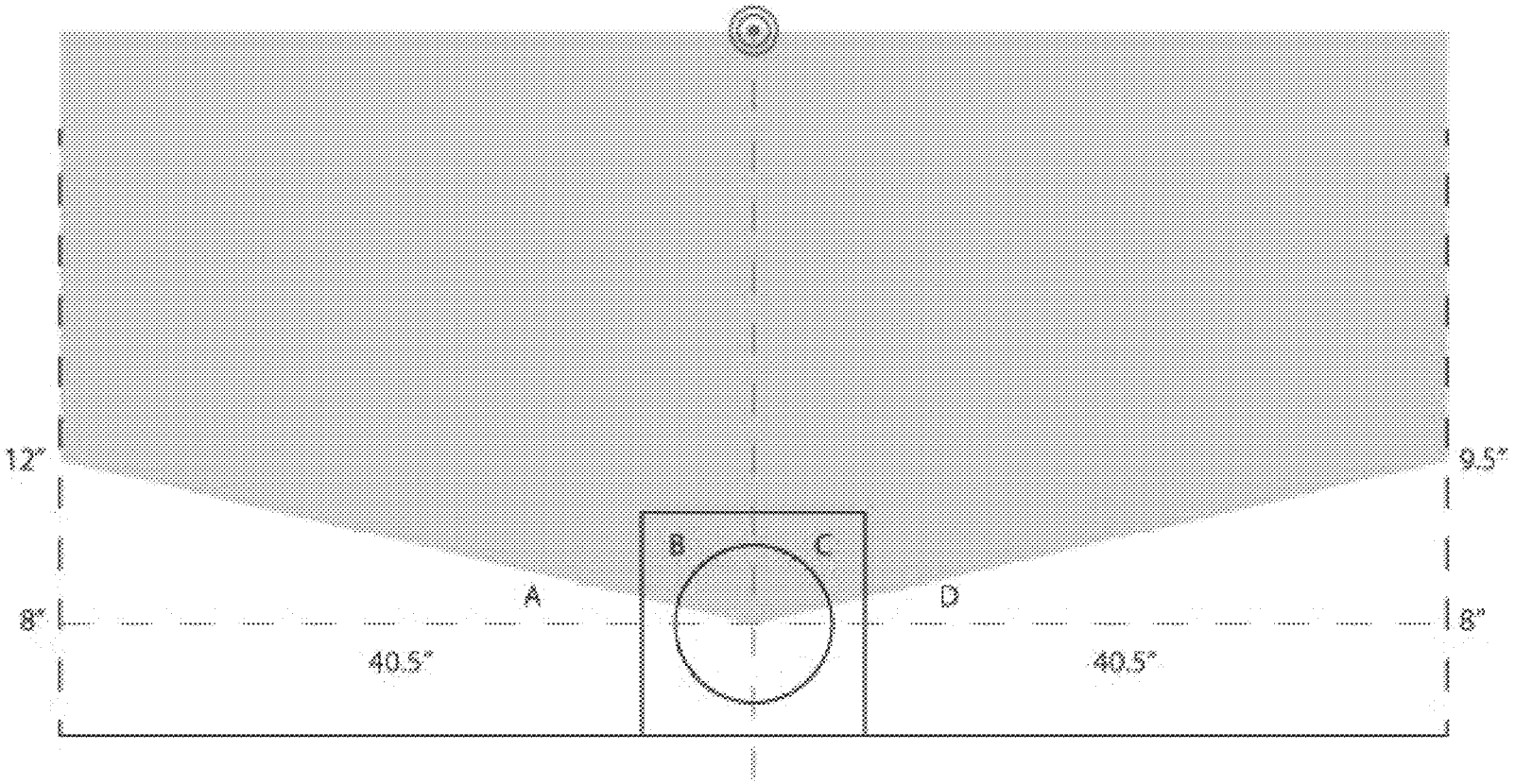
FIG. 10 shows a representation of calculations for determining the horizontal field of view for the first user.

A Horizontal Field of View (FoV) Test:

The subject was asked to sit in a stairwell with their back against a wall, and then a poll was moved in a straight line out from the wall. The measured distance from the wall was taken as a reference point. The measurement indicates the location at which the subject could see the poll. A shorter distance is better. (The base width is 81" inches). The testing set up and measurements for determining the horizontal FoV are depicted in FIG. 9 and the resulting values for calculations (below) are shown in FIG. 10.

User 1:

| Headgear | Right Peripheral (inches) | Left Peripheral (inches) | Up Peripheral (inches) | Up Looking (inches) | Down Peripheral (inches) | Down Looking (inches) |
|---|---|---|---|---|---|---|
| Without Headgear | 9.5 | 12 | 6 | 6.375 | 16.875 | 21 |
| Present Invention Headgear | 18.25 | 19.375 | 6 | 6 | 10.75 | 16 |
| Prior Art Headgear | 34 | 35.25 | 4.625 | 4.625 | 11 | 13.75 |

A Horizontal FoV Calculation: Without Headgear

| | |
|---|---|
| $\tan A = (12 - 8)/40.5$ | $\tan D = (9.5 - 8)/40.5$ |
| $\tan A = 0.09876$ | $\tan D = 0.03704$ |
| $A = \tan^{-1}(0.09876)$ | $D = \tan^{-1}(0.03704)$ |
| $A = 5.6°$ (degrees) | $D = 2.1°$ |
| $B = 90° - A$ | $C = 90° - A$ |
| $B = 90° - 5.6°$ | $C = 90° - 2.1°$ |
| $B = 84.4°$ | $C = 87.9°$ |

Field of View (No Headgear)

$$FoV = B + C$$

$$FoV = 84.4° + 87.9° = 172.3°$$

Therefore the Horizontal FoV for User 1 without headgear was 172.3° (degrees).

A Horizontal FoV Calculation: A Headgear of the Present Invention

| | |
|---|---|
| $\tan A = (19.375 - 8)/40.5$ | $\tan D = (18.25 - 8)/40.5$ |
| $\tan A = 0.28086$ | $\tan D = 0.25309$ |
| $A = \tan^{-1}(0.28086)$ | $D = \tan^{-1}(0.25309)$ |
| $A = 15.7°$ | $D = 14.2°$ |

-continued

| | |
|---|---|
| B = 90° − A | C = 90° − A |
| B = 90° − 15.7° | C = 90° − 14.2° |
| B = 74.3° | C = 75.8° |

Field of View (New Headgear)

$$FoV=B+C$$

$$FoV=84.4°+87.9°$$

$$FoV=150.1°$$

Therefore the Horizontal FoV for User 1 with headgear of the present invention was 150.1° (degrees), meaning that 22.2° of the normal FoV is obstructed by the headgear, or a 12.9% reduction in FoV.

A Horizontal FoV Calculation: A Headgear of the Prior Art

| | |
|---|---|
| tan A = (35.25 − 8)/40.5 | tan D = (34 − 8)/40.5 |
| tan A = 0.67284 | tan D = 0.64197 |
| A = $\tan^{-1}$ (0.67284) | D = $\tan^{-1}$ (0.64197) |
| A = 33.9° | D = 32.7° |
| B = 90° − A | C = 90° − A |
| B = 90° − 33.9° | C = 90° − 14.2° |
| B = 56.1° | C = 57.3° |

Field of View (Prior Art Headgear)

$$FoV=B+C$$

$$FoV=56.1°+57.3°$$

$$FoV=113.4°$$

Therefore the Horizontal FoV for User 1 with the prior art headgear was 113.4° (degrees), meaning that 58.9° of the normal FoV is obstructed by the headgear or a 34.2% reduction in FoV.

Figure 11:
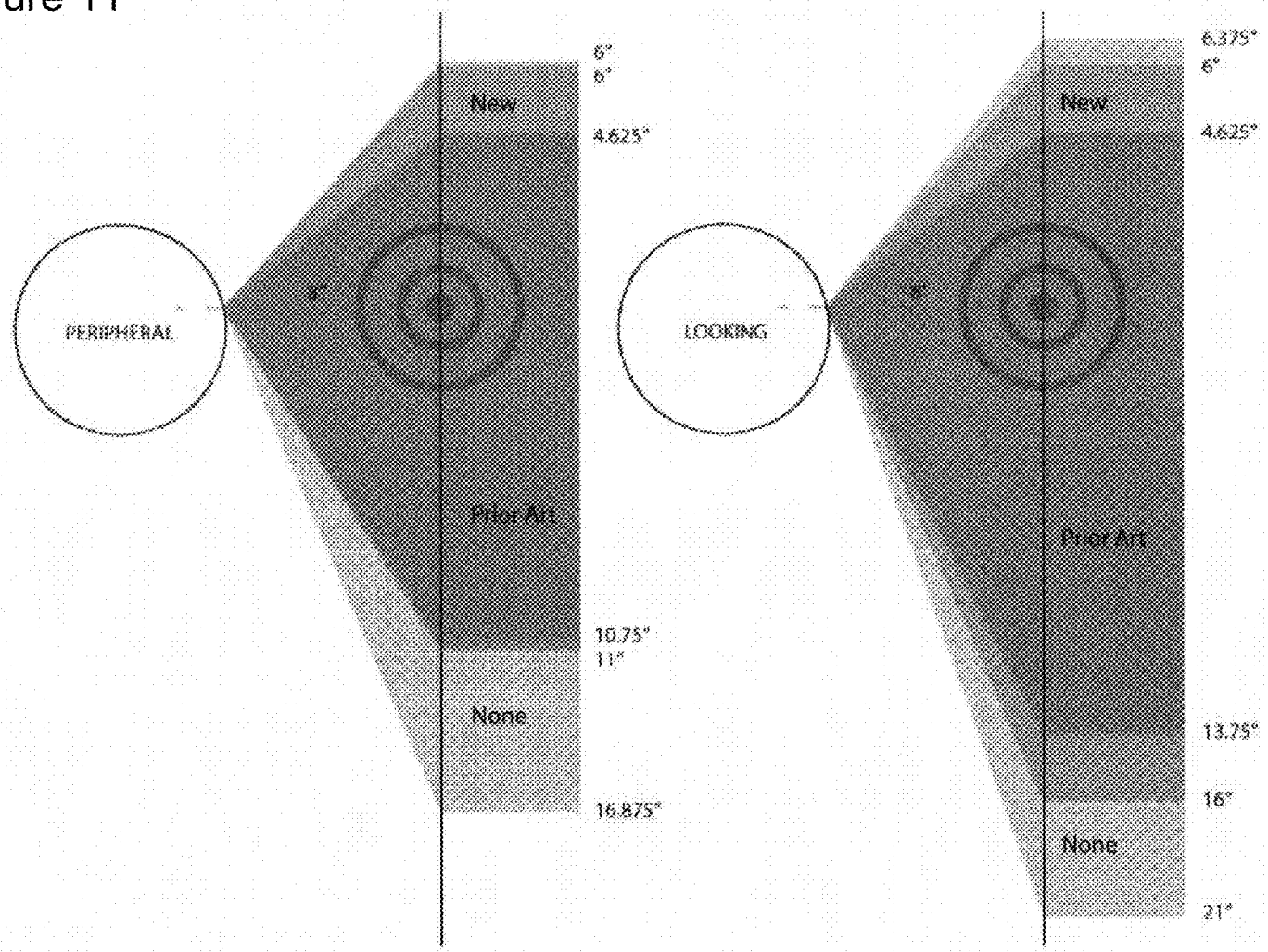
FIG. 11 shows a representation of a test for a vertical field of view for the first user.
Figure 12:
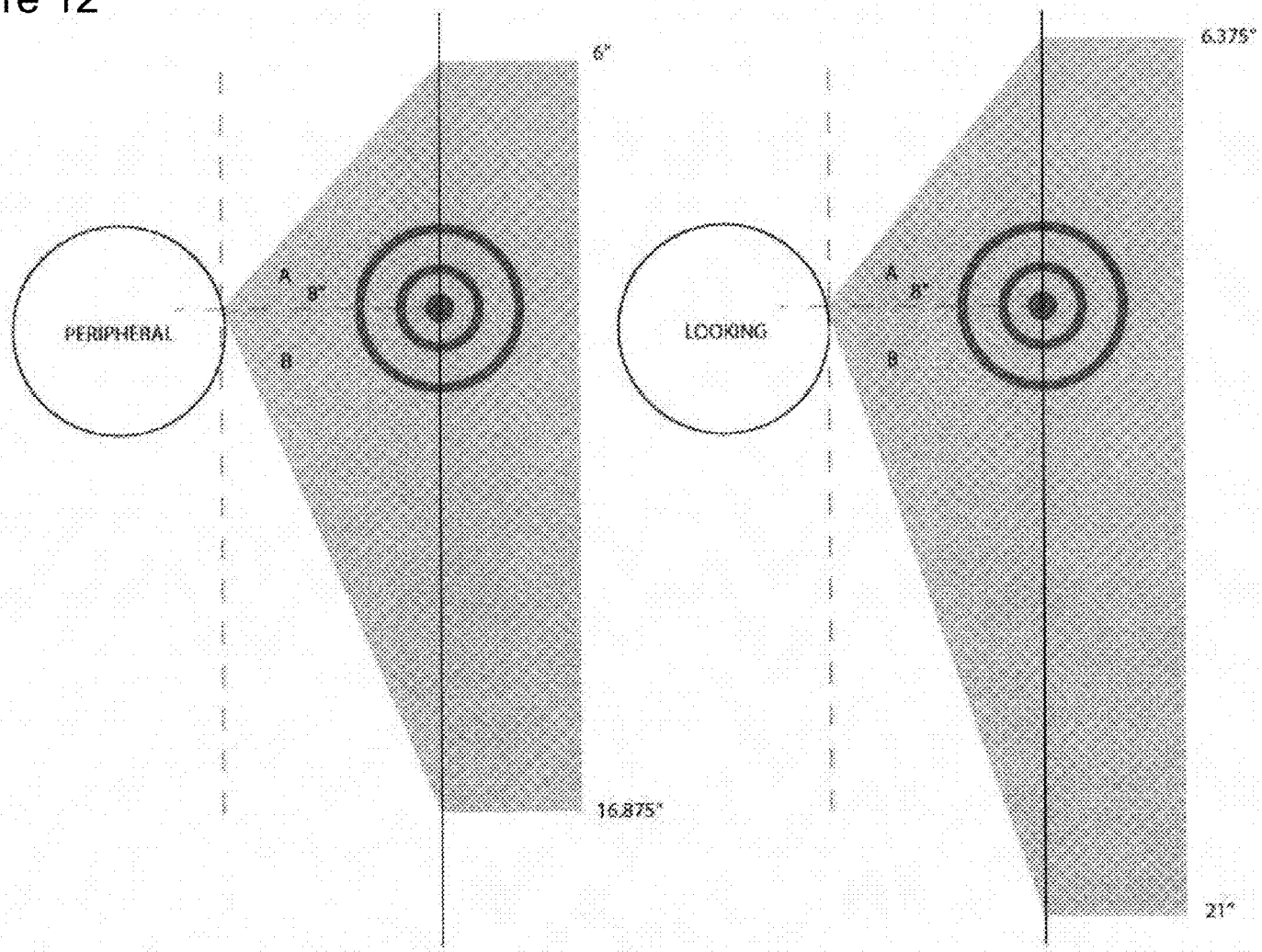
FIG. 12 shows a representation of calculations for determining the field of view for the first user.
Figure 13:
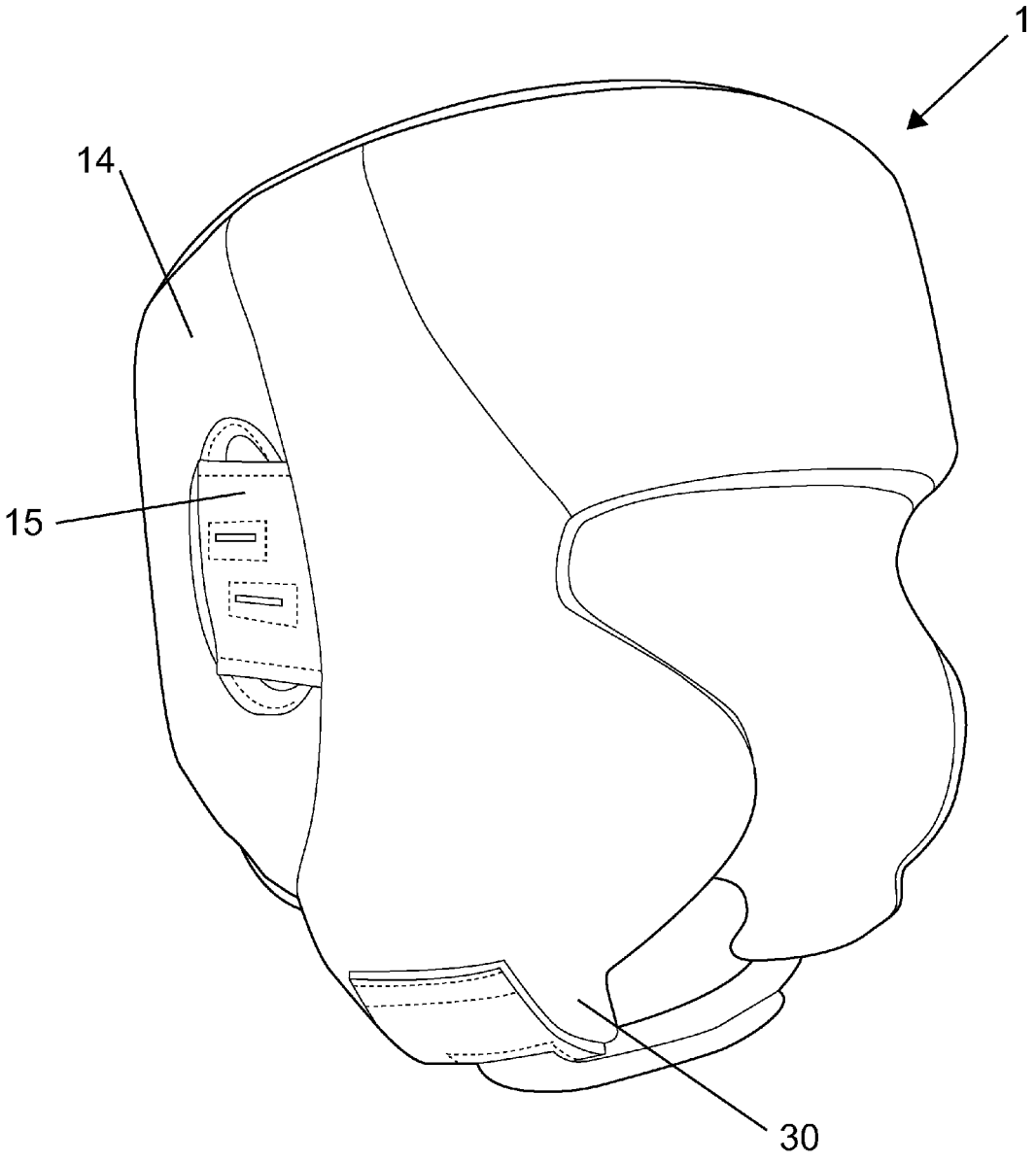
FIG. 13 shows a front perspective view of the headgear showing the chin closure system in accordance with an embodiment of the present invention.

A Vertical FoV Test:

The test required a subject to face a wall with their toes against the base of the wall and stare at a center point on the wall. The peripherals were first tested by having the subject stare at the point and not move their eyes. Then a bar was moved down from the top to see when it came into view, the point where it came into view was marked and measured. The bar was then moved up from the bottom near the floor. The second part of the test was to have the subject look up as far as possible and identify when they would see the bar in their field of view, and then the test was repeated such that the person looked down as far as possible. All measurements were from the center point to the mark. In contrast to the horizontal test, a field of view with longer distances is considered better than shorting distances. The testing set up and measurements for determining the vertical FoV are depicted in FIG. 11, and the resulting values for calculations are shown in FIG. 12.

A Vertical FoV Calculation: Without Headgear

| PERIPHERAL | LOOKING UP AND DOWN |
|---|---|
| tan A = 6/8 | tan A = 6.375/8 |
| tan A = 0.75 | tan A = 0.79686 |
| A = $\tan^{-1}$ (0.75) | A = $\tan^{-1}$ (0.79686) |
| A = 36.7° | A = 38.5° |
| tan B = 16.875/8 | tan B = 21/8 |
| tan B = 2.10936 | tan B = 2.625 |
| B = $\tan^{-1}$ (2.10936) | B = $\tan^{-1}$ (2.625) |
| B = 64.6° | B = 69.1° |

-continued

| Field of View | Field of View |
|---|---|
| FoV = A + B | FoV = A + B |
| FoV = 36.7° + 64.6° | FoV = 38.5° + 69.1° |
| FoV = 101.6° | FoV = 107.6° |

Based on the above results, the Vertical FoV for User 1 without a headgear was 101.6° degrees of peripheral view and 107.6° degrees of view when looking up and down.

A Vertical FoV Calculation: A Headgear of the Present Invention

| PERIPHERAL | LOOKING UP AND DOWN |
|---|---|
| tan A = 6/8 | tan A = 6/8 |
| tan A = 0.75 | tan A = 0.75 |
| A = $\tan^{-1}$ (0.75) | A = $\tan^{-1}$ (0.75) |
| A = 36.7° | A = 36.7° |
| tan B = 10.75/8 | tan B = 16/8 |
| tan B = 1.34375 | tan B = 2 |
| B = $\tan^{-1}$ (1.34375) | B = $\tan^{-1}$ (2) |
| B = 53.3° | B = 63.4° |
| Field of View | Field of View |
| FoV = A + B | FoV = A + B |
| FoV = 36.7° + 53.3° | FoV = 36.7° + 63.4° |
| FoV = 90° | FoV = 100.1° |

Based on the above results, the Vertical FoV for User 1 with headgear of the present invention was 90° of peripheral view and 100.1° of looking up and down view.

Vertical FoV Calculation: A Headgear of the Prior Art

| PERIPHERAL | LOOKING UP AND DOWN |
|---|---|
| tan A = 4.625/8 | tan A = 4.625/8 |
| tan A = 0.57812 | tan A = 0.57812 |
| A = $\tan^{-1}$ (0.57812) | A = $\tan^{-1}$ (0.57812) |
| A = 30° | A = 30° |
| tan B = 11/8 | tan B = 13.75/8 |
| tan B = 1.375 | tan B = 1.71875 |
| B = tan−1 (1.375) | B = tan−1 (1.71875) |
| B = 54° | B = 59.8° |
| Field of View | Field of View |
| FoV = A + B | FoV = A + B |
| FoV = 30° + 54° | FoV = 30° + 59.8° |
| FoV = 84° | FoV = 89.8° |

Based on the above results, the Vertical FoV for User 1 with prior art headgear was 84° of peripheral view and 89.8° of looking up and down view.

The tests as described above were repeated with a different subject (User 2), whereby new data was collected to perform the same calculations as performed for User 1.

User 2:

| Headgear | Right Peripheral (inches) | Left Peripheral (inches) | Up Peripheral (inches) | Looking Up (inches) | Down Peripheral (inches) | Looking Down (inches) |
|---|---|---|---|---|---|---|
| Without Headgear | 8.375 | 9.5 | 10.75 | 13.5 | 14.625 | 18.8125 |
| Present Invention Headgear | 21 | 17.875 | 11.125 | 14.5 | 14 | 15.875 |

-continued

| Headgear | Right Peripheral (inches) | Left Peripheral (inches) | Up Peripheral (inches) | Looking Up (inches) | Down Peripheral (inches) | Looking Down (inches) |
|---|---|---|---|---|---|---|
| Prior Art Headgear | 40.375 | 40 | 4.5625 | 4.5626 | 11.4375 | 14.5 |

A Horizontal FoV: Without Headgear

The Horizontal FoV for User 2 without headgear was 180.2°

A Horizontal FoV: Headgear of the Present Invention

The Horizontal FoV for User 2 with the headgear of the present invention was 151.1° (degrees), meaning that 29.1° of the normal FoV is obstructed by the headgear or a 16.1% reduction in FoV.

A Horizontal FoV: Headgear of the Prior Art

The Horizontal FoV for User 2 with prior art headgear was 104.8°, meaning that 75.4° of the normal FoV is obstructed by the headgear or a 41.8% reduction in FoV.

A Vertical FoV: Without Headgear

The Vertical FoV for User 2 without headgear was 117.9° of peripheral view and 129.2° of looking up and down View.

A Vertical FoV: Headgear of the Present Invention

Therefore the Vertical FoV for User 2 with New headgear was 117.8° of peripheral view and 127.3° of looking up and down view.

Vertical FoV: Prior Art Headgear

Therefore the Vertical FoV for User 2 with prior art headgear was 88° of peripheral view and 93.9° of looking up and down view.

The tests as described above were repeated with a different subject (User 3), whereby new data was collected to perform the same calculations as performed for User 1.

User 3:

| Headgear | Right Peripheral (inches) | Left Peripheral (inches) | Up Peripheral (inches) | Looking Up (inches) | Down Peripheral | Looking Down (inches) |
|---|---|---|---|---|---|---|
| Without Headgear | 13 | 5.0625 | 7.625 | 11.375 | 10.5 | 11.875 |
| Present InventionHeadgear | 22.625 | 19.9375 | 7.4375 | 8.5 | 7 | 7.75 |
| Prior Art Headgear | 29.875 | 28.5625 | 2.5 | 2.9375 | 7.5 | 8.375 |

A Horizontal FoV: Without Headgear

The Horizontal FoV for User 3 without headgear was 181.3°

A Horizontal FoV: Headgear of the Present Invention

The Horizontal FoV for User 3 with New headgear was 147.5°, meaning that 33.8° of the normal FoV is obstructed by the headgear or a 18.6% further obstruction.

A Horizontal FoV: Headgear of the Prior Art

The Horizontal FoV for User 3 with prior art headgear was 127.3°, meaning that 54° of the normal FoV is obstructed by the headgear or a 29.8% further obstruction.

A Vertical FoV: Without Headgear

The Vertical FoV for User 3 without headgear was 114.3° peripheral view and 127.4° looking up and down view.

A Vertical FoV: Headgear of the Present Invention

Therefore the Vertical FoV for User 3 with New headgear was 102.9° peripheral view and 109.3° looking up and down view.

A Vertical FoV: Headgear of the Prior Art

Therefore the Vertical FoV for User 3 with prior art headgear was 76° peripheral view and 82.6° looking up and down view.

| Horizontal FoV | User 1 | User 2 | User 3 | Average |
|---|---|---|---|---|
| Without Headgear | 172.3° | 180.2° | 181.3° | 177.9° |
| Present Invention Headgear | 150.1° | 151.1° | 147.5° | 149.6° |
| Prior Art Headgear | 113.4° | 104.8° | 127.3° | 115.2° |

| Vertical Peripheral FoV | User 1 | User 2 | User 3 | Average |
|---|---|---|---|---|
| Without Headgear | 101.6° | 117.9° | 114.3° | 111.3° |
| Present Invention Headgear | 90° | 117.8° | 102.9° | 103.6° |
| Prior Art Headgear | 84° | 88° | 76° | 82.8° |

| Looking Up and Down Peripheral FoV | User 1 | User 2 | User 3 | Average |
|---|---|---|---|---|
| No Headgear | 107.6° | 129.2° | 127.4° | 121.4° |
| Present Invention Headgear | 100.1° | 127.3° | 109.3° | 112.2° |

-continued

| Looking Up and Down Peripheral FoV | User 1 | User 2 | User 3 | Average |
|---|---|---|---|---|
| Prior Art Headgear | 89.8° | 93.9° | 82.6° | 88.8° |

Therefore, the headgear of the present invention has a horizontal FoV of 149.6°, only obstructing 28.3° or 15.9% of your normal (i.e., without headgear) horizontal FoV; have a vertical FoV of 103.6°, only obstructing 7.7° or 6.9% of your normal vertical FoV. On average, you have a FoV of 144.6°, only obstructing 18° or 12.4% of your normal FoV.

The prior art headgear have a horizontal FoV of 115.2°, obstructing 62.7° or 35.2% of your normal horizontal FoV; have a vertical FoV of 103.6°, obstructing 28.5° or 25.6% of your normal vertical FoV. On average, you have a FoV of 144.6°, further obstructing 45.6° or 31.5% of your normal FoV.

Therefore, the increase in Horizontal FoV was by 34.4° or 22.9% and the increase Vertical FoV was by 20.8° or 20.1%, with an average increase in FoV of 27.6° or 19.1% in comparing the headgear of the present invention to the prior art headgear.

Percentage Change for Horizontal:

Horizontal *FoV* Percentage Change=[(Change from New to Old)/Old *HFoV*]×100

Horizontal *FoV* Percentage Change=[(149.6−115.2)/115.2]×100

Horizontal *FoV* Percentage Change=[(34.4)/115.2]×100

Horizontal *FoV* Percentage Change=29.9%

Percentage Change for Vertical:

Vertical *FoV* Percentage Change=[(Change from New to Old)/Old *VFoV*]×100

Vertical *FoV* Percentage Change=[(103.6−82.8)/82.8]×100

Vertical *FoV* Percentage Change=[(20.8)/82.8]×100

Vertical *FoV* Percentage Change=25.1%

Average FoV Percentage Change:

Average *FoV* Percentage Change=[(Change from New to Old)/Old *VFoV*]×100

Average *FoV* Percentage Change=[(126.6−99)/99]×100

Average *FoV* Percentage Change=[(27.6)/99]×100

Average *FoV* Percentage Change=27.9%

Through experimental testing, the headgear of the present invention was found to be on average about 4 oz lighter than comparable prior art headgear. This is advantageous in terms of comfort for the wearer.

Headgear Weight:

| Headgear | Weight |
|---|---|
| Prior Art Headgear | 16.25 oz |
| Present Invention Headgear | 12.30 oz |
| New Headgear alternative embodiment | 12.35 oz |

The above-described embodiments are intended to be examples of the present invention and alterations and modifications may be effected thereto, by those of skill in the art, without departing from the scope of the invention which is defined solely by the claims appended hereto, which should be given the broadest interpretation consistent with the description as a whole.

What is claimed is:

1. A protective headgear for wearing by an individual comprising:

a body having a crown portion for covering at least a portion of a crown of the individual and opposing first and second side portions for covering at least a portion of the individual's temples;

a first adjustable closure, operatively coupled to the body;

a second adjustable closure, operatively coupled to the body;

wherein the first and second closures are movable to operatively secure the headgear on the individual and are movable in a substantially perpendicular direction relative to one another;

wherein the crown portion and the first and the second side portions of the body each have rear facing inner edges that define a gap; and wherein the first adjustable closure includes:

a first strap for extending horizontally across the gap from a rear facing portion of one of the first and the second side portions of the body and having thereon an adjustable attachment system; and a slot in a rear facing portion of one of the opposing first and second side portions for receiving the first strap;

wherein the second adjustable closure includes:

a second strap for extending substantially vertically across the gap from a portion of the first strap and having thereon a reversible attachment system; and a slot in a rear facing portion of the crown portion of the body for receiving the second strap;

wherein the first adjustable closure is secured by passing the first strap horizontally, across the gap, through the slot in one of the opposing first and second side portion, and by tightening the headgear to the desired fit by pulling the first strap back toward the side portion, and adjustably attaching the first strap to itself and at least a portion of the second strap;

wherein the second adjustable closure is secured by passing the second strap substantially vertically upward across the gap, through the slot in the crown portion, and by tightening the headgear to the desired fit by pulling the second strap downward back toward first strap, and adjustably attaching the second strap to itself; and wherein the reversible attachment system of the second strap secures to at least a portion of the adjustable attachment system of the first strap.

2. The protective headgear of claim 1, wherein a face opening is an hourglass shape, such that the middle of the opening formed by the sides protrudes inward to protect the individual's cheeks.

3. The protective headgear of claim 1, wherein the body further comprises a chin portion for covering at least a portion of a chin of the individual.

4. The protective headgear of claim 3, wherein the chin portion comprises a chin closure system that when closed is contiguous with and forms part of the first and the second side portions.

5. The protective headgear of claim 3, wherein the chin portion is contiguous with and forms part of the first and the second side portions.

6. A method of securely and adjustably applying a protective headgear upon the head of an individual, comprising steps of:

providing the protective headgear, the protective headgear comprising:

a body having a crown portion for covering at least a portion of a crown of the individual and opposing first and second side portions for covering at least a portion of the individual's temples;

a first adjustable closure, operatively coupled to the body;

a second adjustable closure, operatively coupled to the body;

wherein the first and second closures are movable to operatively secure the headgear on the individual and are movable in a substantially perpendicular direction relative to one another;

wherein the crown portion and the first and the second side portions of the body each have rear facing inner edges that define a gap; and wherein the first adjustable closure includes:

a first strap for extending horizontally across the gap from a rear facing portion of one of the first and the second side portions of the body and having thereon an adjustable attachment system; and a slot in a rear facing portion of one of the opposing first and second side portions for receiving the first strap;

wherein the second adjustable closure includes:

a second strap for extending substantially vertically across the gap from a portion of the first strap and having thereon a reversible attachment system; and a slot in a rear facing portion of the crown portion of the body for receiving the second strap;

adjustably securing the first adjustable closure, wherein the first adjustable closure is secured by passing the first strap horizontally, across the gap, through the slot in one of the opposing first and second side portion, and by tightening the headgear to the desired fit by pulling the first strap back toward the side portion, and adjustably attaching the first strap to itself and at least a portion of the second strap;

adjustably securing the second adjustable closure, wherein the second adjustable closure is secured by passing the second strap substantially vertically upward across the gap, through the slot in the crown portion, and by tightening the headgear to the desired fit by pulling the second strap downward back toward first strap, and adjustably attaching the second strap to itself; and securing the reversible attachment system of the second strap to at least a portion of the adjustable attachment system of the first strap.

7. The method of claim 6, wherein the first and the second adjustable closures are straps made of a hook-and-loop type of material for securing the straps.

8. A method for maintaining the field of view of an individual wearing a protective headgear comprising the steps of:

providing the protective headgear, the protective headgear comprising:

a body having a crown portion for covering at least a portion of a crown of the individual and opposing first and second side portions for covering at least a portion of the individual's temples;

a first adjustable closure, operatively coupled to the body;

a second adjustable closure, operatively coupled to the body;

wherein the first and second closures are movable to operatively secure the headgear on the individual and are movable in a substantially perpendicular direction relative to one another;

wherein the crown portion and the first and the second side portions of the body each have rear facing inner edges that define a gap; and wherein the first adjustable closure includes:

a first strap for extending horizontally across the gap from a rear facing portion of one of the first and the second side portions of the body and having thereon an adjustable attachment system; and a slot in a rear facing portion of one of the opposing first and second side portions for receiving the first strap;

wherein the second adjustable closure includes:

a second strap for extending substantially vertically across the gap from a portion of the first strap and having thereon a reversible attachment system; and a slot in a rear facing portion of the crown portion of the body for receiving the second strap;

adjustably securing the first adjustable closure, wherein the first adjustable closure is secured by passing the first strap horizontally, across the gap, through the slot in one of the opposing first and second side portion, and by tightening the headgear to the desired fit by pulling the first strap back toward the side portion, and adjustably attaching the first strap to itself and at least a portion of the second strap;

adjustably securing the second adjustable closure, wherein the second adjustable closure is secured by passing the second strap substantially vertically upward across the gap, through the slot in the crown portion, and by tightening the headgear to the desired fit by pulling the second strap downward back toward first strap, and adjustably attaching the second strap to itself;

securing the reversible attachment system of the second strap to at least a portion of the adjustable attachment system of the first strap; and wherein the adjustable securing of one of the first and the second adjustable closures acts to bias a face opening in the headgear to adopt and maintain a field of view and at least one breathing orifice for the individual.

9. The method of claim 8, wherein the first and the second adjustable closures are straps made of a hook-and-loop type of material for securing the straps.

* * * * *